US005296833A

United States Patent [19]

Breen et al.

[11] Patent Number: 5,296,833

[45] Date of Patent: Mar. 22, 1994

[54] HIGH VOLTAGE, LAMINATED THIN FILM SURFACE MOUNT FUSE AND MANUFACTURING METHOD THEREFOR

[75] Inventors: Barry N. Breen, Givat Zeev; Michael Dakhiya, Kiryat Ono; Irina Daynov, Givat Zeev, all of Israel

[73] Assignee: AVX Corporation, New York, N.Y.

[21] Appl. No.: 48,735

[22] Filed: Apr. 16, 1993

Related U.S. Application Data

[60] Continuation-in-part of Ser. No. 920,113, Jul. 24, 1992, Pat. No. 5,228,188, which is a division of Ser. No. 846,264, Feb. 28, 1992, Pat. No. 5,166,656.

[51] Int. Cl.[5] ..... H01H 85/04; H01H 69/02

[52] U.S. Cl. ..... 337/297; 29/623

[58] Field of Search ..... 337/297; 29/623, 621

[56] References Cited

U.S. PATENT DOCUMENTS 5,166,656 11/1992 Badihi et al. ..... 337/297

*Primary Examiner*—Harold Broome

*Attorney, Agent, or Firm*—Spensley Horn Jubas & Lubitz

[57] ABSTRACT

A surface mount fuse device comprising an alumina-glass-fuse-glass-alumina laminated structure provides high voltage ratings and superior mechanical and thermal properties.

6 Claims, 1 Drawing Sheet

HIGH VOLTAGE, LAMINATED THIN FILM SURFACE MOUNT FUSE AND MANUFACTURING METHOD THEREFOR

CROSS REFERENCE TO RELATED APPLICATIONS

The present application is a continuation-in-part of application Ser. No. 07/920,113 filed Jul. 24, 1992 for "Method of Making Thin Film Surface Mount Fuses" now U.S. Pat. No. 5,228,188 which application is, in turn, a divisional of application Ser. No. 07/846,264 filed Feb. 28, 1992 for "Thin Film Surface Mount Fuses," now U.S. Pat. No. 5,166,656 issued Nov. 24, 1992.

FIELD OF THE INVENTION

The present invention relates generally to electrical fuses and particularly to surface mount fuses employing thin film technology. The invention further relates to methods for fabricating such fuses.

BACKGROUND OF THE INVENTION

Surface mounting has become the preferred technique for circuit board assembly and virtually all types of electronic components have been or are being redesigned for surface mount, that is, leadless, applications. The rapid incorporation of surface mount devices (SMD) into all types of electronic circuits has created a demand for SMD fuses.

Fuses serve an essential function on many circuit boards. By fusing selected sub-circuits and even certain individual components it is possible to prevent damage to an entire system which may result from failure of a local component. For example, fire damage to a mainframe computer can result from the failure of a tantalum capacitor; a short in a single line card might disable an entire telephone exchange.

The required characteristics for circuit board fuses are small size, low cost, accurate current-sensing, very fast reaction or blow time and the ability, in the case of time lag fuses, to provide surge resistance.

Prior art tube type or leaded fuses take up excessive space on circuit boards designed for SMD assembly and add significantly to production costs. Recognizing the need for fuses compatible with SMD assembly techniques, several manufacturers offer leadless, molded fuses for standard SMD assembly. The devices provided by this approach, however, remain bulky (for example, package sizes of about 7×4×3 mm), expensive and of limited performance range. Most importantly, the characteristics of fuses of the aforedescribed prior art cannot be accurately controlled during manufacture.

The above referenced U.S. patent and application show that thin film technology provides a high level of control of all fuse parameters, thus making possible economical standard and custom fuse designs meeting a wide range of fusing requirements. Thus, thin film technology enables the development of fuses in which both electrical and physical properties can be tightly controlled. The advantages of the technology are particularly evident in the areas of physical design, repeatability of fusing characteristics and $I^2t$ "let-through". Moreover, because present techniques allow line width resolution below 1 μm and control of layer thickness to 100 Å, the fabrication of true miniature SMD fuses having standard (for example, 1.6×0.8 mm) and non-standard package sizes are made possible.

The referenced U.S. patent and application also disclose methods of manufacturing a thin film surface mount electrical fuse in which, first, a uniform thin metal film of aluminum is deposited by sputtering or the like on a surface of an insulating substrate such as glass. The thickness of the film is dependent upon, among other things, the fuse rating. Selected portions of the thin metal film are then removed by photolithographic techniques to define a repetitive pattern comprising a plurality of identical fuse elements each comprising a pair of contact portions interconnected by a fusible link having a width smaller than that of the contact portions. The structure is then passivated and an insulating cover plate of glass is bonded by epoxy over the passivation layer. The assembly formed by the preceding steps is next cut into strips along end planes normal to the surface of the substrate, each strip including a series of side-by-side fuses. This cutting step exposes edges of the contact portions of each fuse element along the end planes of the strips. Conductive termination layers are deposited over the end planes thereby electrically connecting the terminations to the exposed edges of the contact portions. Last, the strips are cut transversely into individual fuses.

The photolithographic production method allows a great variety of fuse element designs and substrate types to be combined for creating a wide range of fuse chips. Moreover, critical parameters such as fuse speed can be programmed to optimally satisfy application requirements. Finally, the hermetic structure of the thin film fuse provided by the sealing glass cover plate imparts excellent environmental reliability.

The glass-fuse-glass layered structure described in the aforementioned patent application does have several limitations. Although glass has the desirable thermal properties needed for "quick" rated thin film fuses, it is fragile. The voltage ratings of such fuses are thus limited, for example, to 32 volts, because the application of high voltages would fracture the fuse body. The mechanical bending strength of the glass-fuse-glass structure is likewise limited by the fragility of the glass, as is the thermal cycling ability of the structure.

Accordingly, it is an overall object of the present invention to provide a thin film surface mount fuse having voltage ratings that are higher than previously possible while maintaining the "quick" rating thereof.

It is another object of the invention to provide a thin film surface mount fuse structure that has improved mechanical strength and reliability, as well as a greater thermal cycling ability.

It is yet another object of the present invention to provide methods of manufacturing such improved thin film surface mount fuses.

SUMMARY OF THE INVENTION

In accordance with one exemplary form of the present invention, there is provided a thin film fuse which is made by depositing a fuse element on a thin glass substrate. A thin alumina cover is then bonded to the back or bottom surface of the glass substrate. A thin glass cover is bonded over the fuse layer and a thin alumina cover is then bonded on the top surface of the thin glass cover. The resulting alumina-glass-fuse-glass-alumina laminated structure has the advantages of the prior glass-fuse-glass fuse structure while minimizing its disadvantages and retaining the same form factor of package dimensions. The "quick" rated fusing capabilities made possible by the thermal properties of glass are retained while the use of thin alumina top and bottom layers significantly strengthens the fuse without modifying fuse speed. As a further result, voltage ratings are increased substantially, for example, from 32 volts to 63 volts (and even higher), and mechanical bending strength and thermal cycling capabilities are enhanced. The increased mechanical strength of the new fuse structure allows it to be used to protect circuits built on plastic or ceramic boards, which was not previously possible.

BRIEF DESCRIPTION OF THE DRAWINGS

Further objects, features and advantages of the present invention will become apparent from the detailed description of the preferred embodiments, below, when read in conjunction with the accompanying drawings in which.

DETAILED DESCRIPTION OF THE PREFERRED EMBODIMENT

Figure 1:
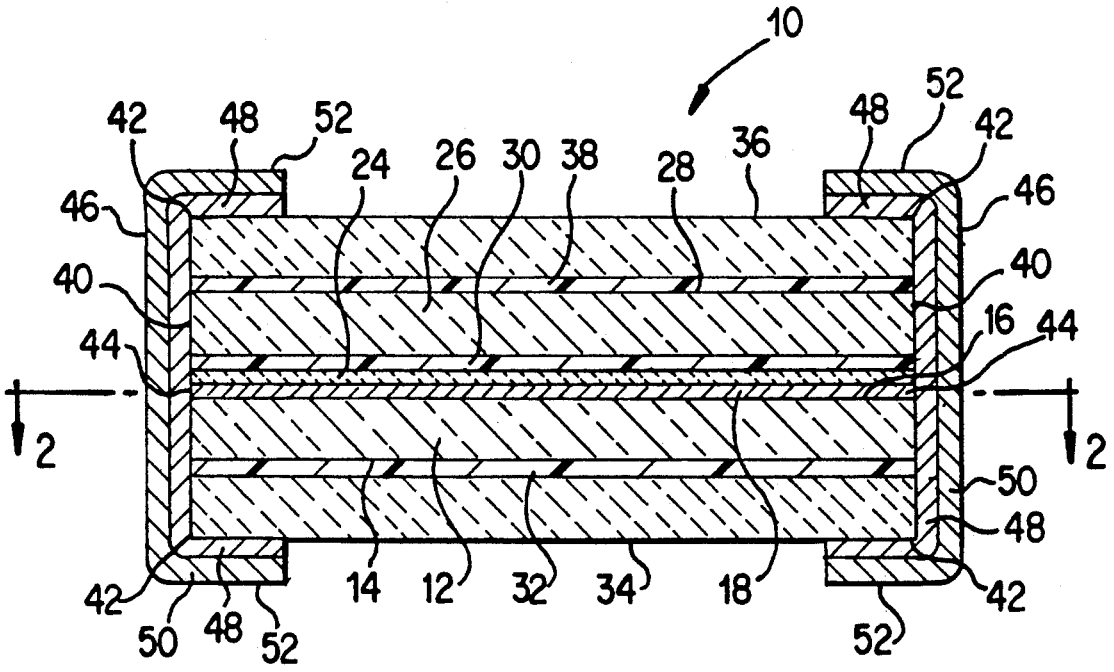
FIG. 1 is a side elevation view, in cross section, of a fuse in accordance with the present invention.
Figure 2:
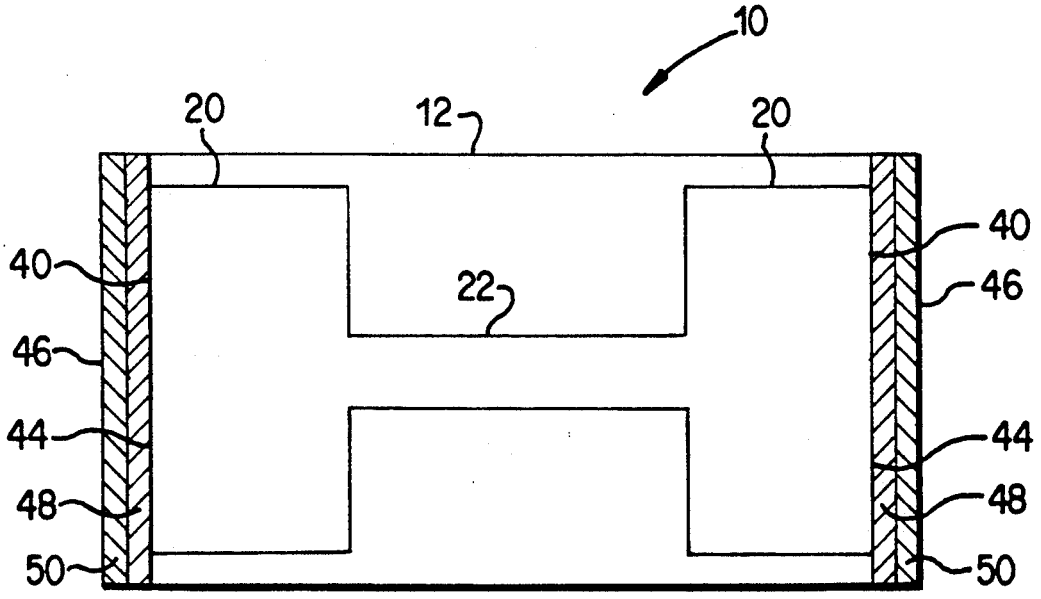
FIG. 2 is a cross section view of the fuse of FIG. 1 as seen along the line 2—2.

FIGS. 1 and 2 show a laminated thin film SMD fuse 10 in accordance with a preferred embodiment of the invention. (It will be evident that the thicknesses of the various layers of the structure shown in the drawings are not to scale and have been greatly exaggerated for clarity.)

The fuse 10 includes a substrate 12, preferably a thin glass plate having a thickness, for example, of about 0.30 mm. The substrate has a lower surface 14 and an upper planar surface 16 coated with a thin film of metal, such as aluminum, configured to define one or more fuse elements 18. By way of example, the metallic film may have a thickness ranging from 0.6 μm or less to 4.5 μm or more. The fuse element 18 comprises a pair of contact portions 20 interconnected by a fusible link 22 substantially narrower than the contact portions 20. By way of example, a fuse element having a 0.2 amp rating may have an overall length of 116 mils, a width of 51 mils and a fusible link having a length of 10 mils and a width of 1 mil. The thickness of the thin film for such a fuse may be 0.6 μm.

Protecting the thin film fuse element 18 and the surrounding portions of the upper surface 16 of the substrate 12 is a silica passivation layer 24. A thin glass cover 26 coextensive with the substrate 12 and having an upper surface 28, is bonded to the passivation layer 24 by an epoxy layer 30 which also serves to seal the fuse element. The glass cover 26, like the glass substrate 12, may have a thickness of about 0.30 mm.

Bonded by an epoxy layer 32 to the lower surface 14 of the glass substrate 12 is a thin alumina cover 34. The alumina cover 34 may have a thickness of about 0.25 mm. Likewise, a top alumina cover 36, also having a thickness of about 0.25 mm is bonded by an epoxy layer 38 to the top surface of the glass cover 26. It should be noted that alumina cannot by placed in direct contact with the fuse layer because the high heat transfer characteristics of alumina would result in an excessively fast fuse with high power dissipation. However, by bonding thin alumina layers to the top and bottom surfaces of the basic glass-fuse-glass fuse structure, the fuse is significantly strengthened and higher voltage ratings are made possible without modifying fuse speed. Fuses according to the invention may have voltage ratings of 63 volts, and even 125 volts. The greater bending strength permits deflections of 3 mm instead of only 1 mm and the new fuse is capable of, for example, 140 thermal cycles (rapid temperature cycling between −55° C. and +125° C.) instead of only 5 thermal cycles. This increased strength and thermal cycling capabilities permit fuses of the present invention to be used to protect circuits built not only on glass epoxy circuit boards, but on plastic and ceramic boards as well.

As already explained, alumina substantially strengthens the final fuse structure because of alumina's superior mechanical properties, such as tensile and bending strengths, which significantly exceed those of glass. Other insulating, high strength materials, such as sapphire, will suggest themselves to those skilled in the art for use in place of alumina. Alumina, however, has the advantage of low cost.

The alumina-glass-fuse-glass-alumina laminated fuse assembly so far described is preferably in the form of a rectangular prism having parallel end planes 40 and end corners 42 bounding the end planes. End edges 44 of the fuse element contact portions 20 lie in the end planes 40.

Covering the planar end surfaces 40 are conductive terminations 46 each composed of an inner layer 48 of nickel, chromium or the like, and an outer solder coating 50. Each inner layer 48 is in contact with an end edge 44 of one of the contact portions 20 to provide an electrical connection between the terminations 46 and the opposed ends of the fuse element 18.

The terminations 46 include lands 52 extending around the corners 42 and along portions of the lower surface of the bottom alumina cover 34 and the upper surface of the top alumina cover 36.

The thin film fuse of the invention is highly reliable. The protective cover plates are temperature stable and hermetic, thereby protecting the fuse element 18 when the fuse is exposed to high temperature and humidity environments. The protective covers are also electrically stable even under the extreme conditions which exist during fuse actuation. High insulation resistance (>1MΩ) is consistently maintained after fuse actuation, even at circuit voltages of 125 V (50 A maximum breaking current).

The above-referenced patent and application describe fabrication processes for the manufacture of glass-fuse-glass fuse structures which processes are fully applicable to the manufacture of fuse structures of the present invention; the portions of the referenced patent and application relating to said processes are incorporated herein by reference.

Pursuant to the invention, the ability to define or program very accurately the width, length, thickness and conductivity of the fuse element results in minimal variability in fuse characteristics. Further, a large variety of fuse element designs and substrate types can be combined to create fuses having a range of speed characteristics. For example, fast fuses can be produced by using a low mass fuse element on a conductive substrate, while slower fuse characteristics can be obtained from a combination of a high mass fuse element and a thermally isolated substrate. The unique 5-layer laminated construction of fuse components according to the invention further invests such components with superior mechanical and thermal properties providing "quick" fuses with higher voltage ratings and an extended range of circuit board environments.

What is claimed is:

1. In a method of manufacturing a surface mount electrical fuse, the steps of:

applying a thin metal film to a top surface of an insulating substrate, the substrate having a bottom surface;

removing selected portions of the thin metal film to define a fuse element comprising a pair of contact portions interconnected by at least one fusible link having a width smaller than that of the contact portions;

bonding an insulating cover to the structure formed by the preceding step, the insulating cover having a top surface;

bonding a cover layer to the bottom surface of the insulating substrate; and bonding a cover layer to the top surface of the insulating cover, the cover layers being formed of a material having a mechanical strength that is greater than that of the substrate and insulating cover.

2. A method, as defined in claim 1, in which:

the substrate and insulating cover comprise glass and the cover layers comprise alumina.

3. A method, as defined in claim 1, further including the step of:

passivating the thin metal film and the adjacent top surface of the insulating substrate.

4. A thin film surface mount fuse comprising:

a generally rectangular, insulating substrate having an upper planar surface, opposite end surfaces perpendicular to the top surface and a lower planar surface;

a deposited, electrically conductive thin film on the upper surface of the substrate, the thin film defining a fuse element comprising a pair of contact portions interconnected by at least one link having a width smaller than that of the contact portions, the link being fusible in response to a predetermined current therethrough, each of the contact portions having an exposed outer edge flush with an end surface of the substrate;

an insulating cover coextensive with the substrate and having end surfaces, the insulating cover being bonded to the upper surface of the insulating substrate, the end surfaces of the substrate and cover and the outer edges of the thin film element defining opposed end faces of the surface mount fuse, the insulating cover having an upper planer surface;

a first cover layer coextensive with the insulating cover and bonded to upper surface thereof, the first cover layer having an upper surface;

a second cover layer coextensive with the insulating substrate and bonded to the lower surface thereof, the second cover layer having a lower surface, the first and second cover layers having a mechanical strength greater than that of the substrate and insulating cover; and an electrically conductive termination covering each of the end faces of the fuse and being in electrical contact with the outer edge of one of the contact portions of the fuse element, each termination having a leg extending along a portion of the upper surface of the first cover layer and a leg extending along a portion of the lower surface of the second cover layer.

5. A fuse, as defined in claim 4, in which:

a passivation layer covers the thin film fuse element.

6. A fuse, as defined in claim 4, in which:

the insulating substrate and insulating cover comprise glass layers and the cover layers comprise alumina.

* * * * *